US006249661B1

(12) United States Patent
Saitoh et al.

(10) Patent No.: US 6,249,661 B1
(45) Date of Patent: Jun. 19, 2001

(54) DEVICE FOR SUPPORTING AN IMAGE CARRIER INCLUDED IN AN IMAGE FORMING APPARATUS

(75) Inventors: Hiroshi Saitoh, Ayase; Hiroshi Hosokawa, Yokohama, both of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 08/608,535

(22) Filed: Feb. 28, 1996

Related U.S. Application Data

(63) Continuation-in-part of application No. 08/352,232, filed on Dec. 8, 1994, now abandoned.

(30) Foreign Application Priority Data

| | | |
|---|---|---|
| Dec. 8, 1993 | (JP) | 5-308061 |
| Aug. 17, 1994 | (JP) | 6-214359 |
| Apr. 28, 1995 | (JP) | 7-127588 |

(51) Int. Cl.[7] ..... G03G 15/00
(52) U.S. Cl. ..... 399/117
(58) Field of Search ..... 399/117, 159, 399/111, 116

(56) References Cited

U.S. PATENT DOCUMENTS

| | | | | |
|---|---|---|---|---|
| 5,052,090 | * | 10/1991 | Kitaura et al. | 399/159 |
| 5,130,751 | * | 7/1992 | Sato et al. | 399/117 X |
| 5,142,322 | | 8/1992 | Surti . | |
| 5,347,343 | * | 9/1994 | Ohtsuka et al. | 399/111 |
| 5,353,100 | * | 10/1994 | Ohtsuka | 399/111 |
| 5,422,706 | * | 6/1995 | Tsunemi et al. | 399/159 |
| 5,446,525 | * | 8/1995 | Kobayashi | 399/111 |

FOREIGN PATENT DOCUMENTS

| | | |
|---|---|---|
| 41 38 079 | 10/1992 | (DE) . |
| 43 23 970 | 1/1994 | (DE) . |
| 58-194079 | 11/1983 | (JP) . |
| 62-127785 | 6/1987 | (JP) . |
| 3-46674 | 2/1991 | (JP) . |
| 3-191365 | 8/1991 | (JP) . |
| 4-78888 | 3/1992 | (JP) . |
| 4-358192 | 12/1992 | (JP) . |

* cited by examiner

*Primary Examiner*—Quana M. Grainger
(74) *Attorney, Agent, or Firm*—Oblon, Spivak, McClelland, Maier & Neustadt, P.C.

(57) ABSTRACT

In an image forming apparatus, a device for supporting a photoconductive element or image carrier includes an implementation which allows the element to be rapidly and easily dismounted from the apparatus together with its shaft, i.e., without having the shaft pulled out or inserted. Therefore, the device enhances easy replacement of the photoconductive element. The operation is simple because the photoconductive element and shaft do not have to be handled independently of each other.

40 Claims, 13 Drawing Sheets

DEVICE FOR SUPPORTING AN IMAGE CARRIER INCLUDED IN AN IMAGE FORMING APPARATUS

This application is a continuation-in-part of Ser. No. 08/352,232 filed Dec. 8, 1994 now abandoned.

BACKGROUND OF THE INVENTION

The present invention relates to a copier, laser printer, facsimile apparatus or similar electrophotographic image forming apparatus and, more particularly, to a device for supporting an image carrier included in such an apparatus and implemented as a photoconductive drum.

It has been customary with an image forming apparatus of the type described to rotatably mount an image carrier, e.g., a photoconductive drum on a shaft which is affixed to the side walls of the apparatus body. To replace the drum, the shaft is unlocked and then removed from the apparatus body and drum so as to release the drum. Subsequently, the drum is removed from the apparatus body. The drum may be constructed into a unit together with a section for storing fresh toner and a section for collecting used toner or waste toner, as known in the art. This kind of unit is also removed from the apparatus body by pulling out a shaft supporting the drum and then removing the entire unit from the apparatus body. In any case, the drum is replaced after the shaft supporting it has been pulled out. However, pulling out the shaft from the apparatus body and drum with one hand while holding the drum with the other hand is not only time- and labor-consuming but also needs a great deal of skill. Moreover, despite that a new drum to be mounted to the apparatus body should have the photoconductive surface thereof kept off the operator's hands, the portion of the drum which can be directly touched is limted. In this way, the operation for mounting and dismounting a photoconductive drum available with the conventional apparatus is troublesome.

Further, in the unit configuration mentioned above, the shaft of the drum is supported by the apparatus body while a developing roller is supported by the unit. This brings about a problem that the distance between the drum and the developing roller is fixed. When the drum and developing roller fail to contact each other evenly in the axial direction or are not parallel to each other due to, e.g., irregularities in their outside diameters, the resulting images suffer from irregularities.

SUMMARY OF THE INVENTION

It is therefore an object of the present invention to provide a supporting device which allows a photoconductive drum to be replaced rapidly and easily.

In accordance with the present invention, an image forming apparatus has a photoconductive drum, and a device for supporting the drum. The device has a shaft supporting the drum at the axis of the drum, a pair of flanges respectively affixed to opposite ends of the drum, and each being formed with a bearing hole at the center thereof, the shaft extending throughout the bearing hole to allow the flange to slide thereon, a pair of locking members formed at opposite ends of the shaft, and each comprising flat surfaces facing each other and formed by cutting away part of the periphery of the end of the shaft in parallel planes at opposite sides of the axis, and round surfaces facing each other and formed by the other part of the periphery, a pair of shaft support members for respectively holding the locking members, and each comprising an opening for passing the flat surfaces of the respective locking member therethrough, and a circular hole communicated to the opening for engaging with the round surfaces of the respective locking member, and a pair of knob members respectively provided on the opposite ends of the shaft.

Also, in accordance with the present invention, an image forming apparatus has a photoconductive drum, and a device for supporting the drum. The device has a pair of flanges respectively affixed to opposite ends of the drum, a conductive shaft press fitted in a through bore formed in the center of one of the flanges, while partly protruding from the through bore, a shaft support member rotatably supporting the conductive shaft, a first positioning member for positioning the drum by holding the shaft support member, a flange support member rotatably supporting the other flange, and a second positioning member for positioning the drum by holding the flange support member.

Further, in accordance with the present invention, a device for supporting an image carrier included in an image forming apparatus has a pair of flanges respectively mounted on opposite ends of the image carrier, and having respective through bores formed therein. A shaft extends throughout the through bores of the pair of flanges. A pair of locking members are respectively formed at opposite ends of the shaft, and each has flat portions facing each other and curved portions facing each other and formed by having the circumferential surface thereof cut away in parallel planes at opposite sides of the axis of the shaft. The locking members each has an oval shape in a section perpendicular to the axis of the shaft. A pair of shaft support members each includes a circular hole having an inside diameter capable of receiving the arcuate portions of one of the locking members, and an opening communicated to the circular hole and for passing the flat portions of the locking member therethrough. The locking members are respectively received in the circular holes of the shaft support members to thereby lock the shaft in position.

Furthermore, in accordance with the present invention, a device for supporting an image carrier included in an image forming apparatus has a pair of flanges respectively mounted on opposite ends of the image carrier, and having respective through bores formed therein. A shaft extends throughout the through bores of the flanges. A pair of notched portions are respectively formed at opposite ends of the shaft, and each has flat portions facing each other and curved portions facing each other and formed by having the circumferential surface thereof cut away in parallel planes at opposite sides of the axis of the shaft. The locking members each has an oval shape in a section perpendicular to the axis of the shaft. A pair of shaft support members each includes a circular hole having an inside diameter capable of receiving the arcuate portions of one of the notched portions, and an opening communicated to the circular hole and for passing the flat portions of the notched portion. A pair of affixing members respectively affix the pair of shaft support members. The notched portions are respectively affixed to the affixing members via the associated shaft support members.

Moreover, in accordance with the present invention, a device for supporting an image carrier included in an image forming apparatus and implemented as a photoconductive drum has a shaft supporting the drum at the axis of the drum, a pair of flanges respectively affixed to opposite ends of the drum, and each being formed with a bearing hole at the center thereof, the shaft extending throughout the bearing hole to allow the flange to slide thereon, a pair of locking members formed at opposite ends of the shaft, and each comprising flat surfaces facing each other and formed by cutting away part of the periphery of the end of the shaft in parallel planes at opposite sides of the axis, and round surfaces facing each other and formed by the other part of the periphery, a pair of shaft support members for respectively holding the locking members, and each comprising an opening for passing the flat surfaces of the respective locking member therethrough, and a circular hole communicated to the opening for engaging with the round surfaces of the respective locking member, and a pair of knob members respectively provided on the opposite ends of the shaft.

In addition, in accordance with the present invention, a device for supportin an image carrier included in an image forming apparatus and implemented as a photoconductive drum has a pair of flanges respectively affixed to opposite ends of the drum, a conductive shaft press fitted in a through bore formed in the center of one of the flanges, while partly protruding from the through bore, a shaft support member rotatably supporting the conductive shaft, a first positioning member for positioning the drum by holding the shaft support member, a flange support member rotatably supporting the other flange, and a second positioning member for positioning the drum by holding the flange support member.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Preferred embodiments of the image carrier supporting device in accordance with the present invention will be described hereinafter.

1st Embodiment

Figure 1:
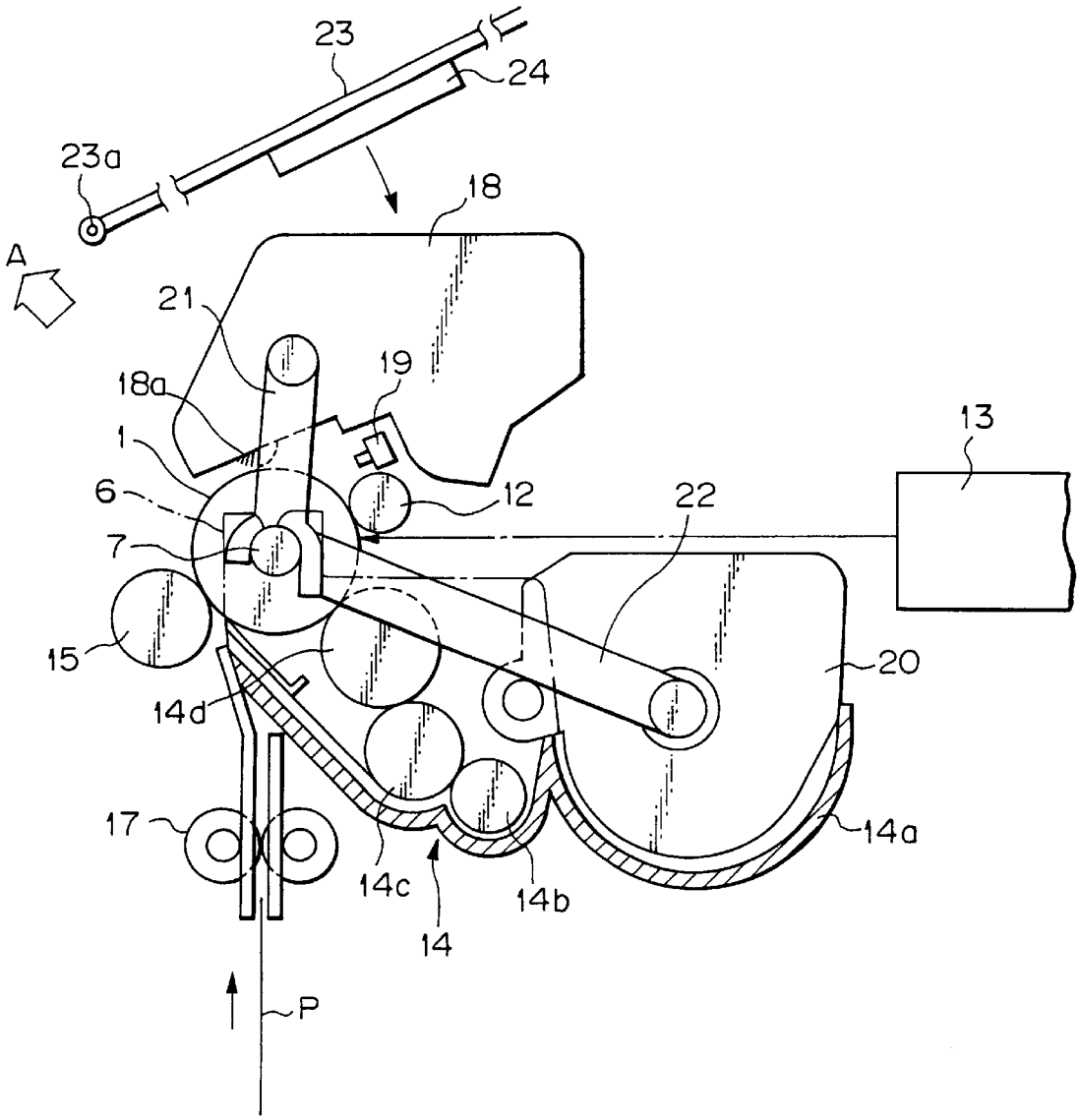
FIG. 1 is a fragmentary section of an image forming apparatus to which a first embodiment of the image carrier supporting device in accordance with the present invention is applicable.

Referring to FIG. 1 of the drawing, the essential part of a copier, which is a specific form of an image forming apparatus, is shown to which a first embodiment of the image carrier supporting device in accordance with the present invention is applied. As shown, the copier has an image carrier in the form of a photoconductive drum 1. The drum 1 is made up of a core made of metal and a photoconductive layer formed on the core. The drum 1 is mounted on a shaft 7 which is, in turn, held by shaft support members 6 (only is visible). The shaft support members 6 form part of a developing unit 14. A charge roller 12 uniformly charges the surface of the drum 1 to a predetermined polarity. An optical writing unit 13 forms an electrostatic latent image on the charged surface of the drum 1 by exposing it imagewise. A transfer roller 15 transfers toner image from the drum 1 to a paper P. A pair of register rollers 17 drive the paper P toward the transfer roller 15 at a predetermined timing. A used toner or waste toner tank 18 has a brush roller 18*a* for scraping off toner remaining on the drum 1 after the image transfer. A discharge lamp 19 dissipates charges also remaining on the drum 1 after the image transfer, thereby restoring the drum 1 to the original state. A fresh toner tank 20 stores fresh toner therein and is mounted to a hopper 14*a*. A toner supply roller 14*b* supplies the fresh toner from the hopper 14*a* to a developing roller 14*c*. The toner is deposited on the developing roller 14*c* in a layer. A conveyor roller 14*d* is mounted on the developing unit 14 via a shaft, not shown, and held in contact with the developing roller 14*c* and drum 1 to transfer the toner from the former to the latter. There are also shown in the figure first arm 21 ( only one is visible), second arm 22 (only one is visible), a top cover 23 hinged to the copier body by a shaft 23*a,* and a presser member 24 mounted on the top cover 23 for pressing the waste toner tank 18 downward.

The first arms 21 are affixed to the waste toner tank 18 at one end thereof. The other end of each arm 21 is notched in the form of a letter U and engaged with the shaft 7 at a predetermined position, e.g., between one end of the drum 1 and the adjoining shaft support member 6. In this condition, the arms 21 constantly urge the shaft 7 downward due to the weight of the tank 18. The second arms 22 are affixed to the fresh toner tank 20 at one end thereof. The other end of each arm 22 is provided with the same configuration as that of the arm 21 and also engaged with the shaft 7. The waste toner tank 18 and fresh toner tank 20 are connected to each other by the first and second arms 21 and 22.

To replace the drum 1, the two tanks 18 and 20 connected together by the arms 21 and 22 are removed from the housing upward at the same time. For this purpose, the arms 21 and 22 are removed from the shaft 7 while the tanks 20 and 18 are respectively removed from the hopper 14*a* and a support member, not shown. Then, the drum 1 is picked up in a direction indicated by an arrow A via the space above the drum 1 which is now uncovered.

Figure 2:
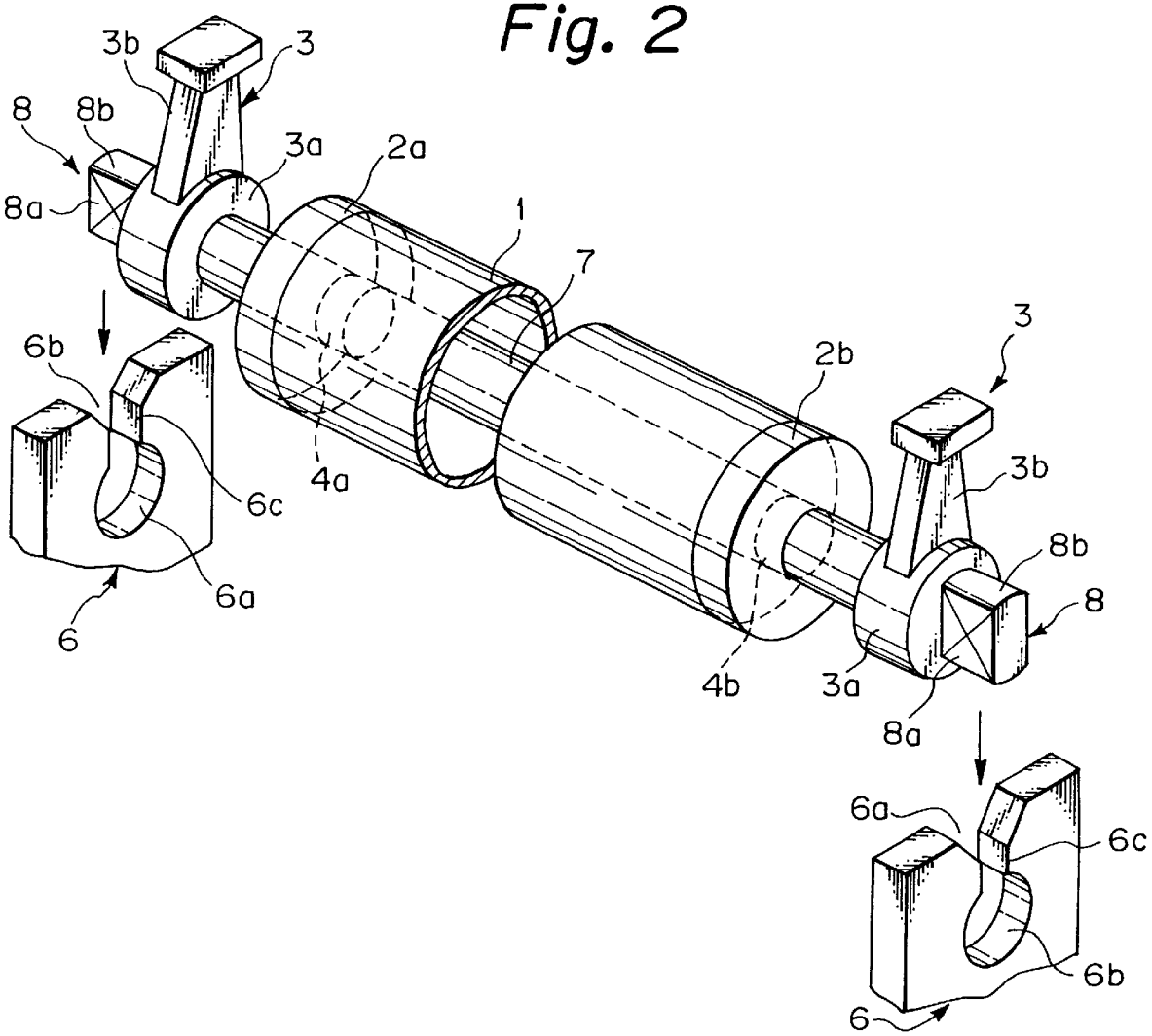
FIG. 2 and 3 show the first embodiment in a perspective view and a section, respectively.
Figure 3:
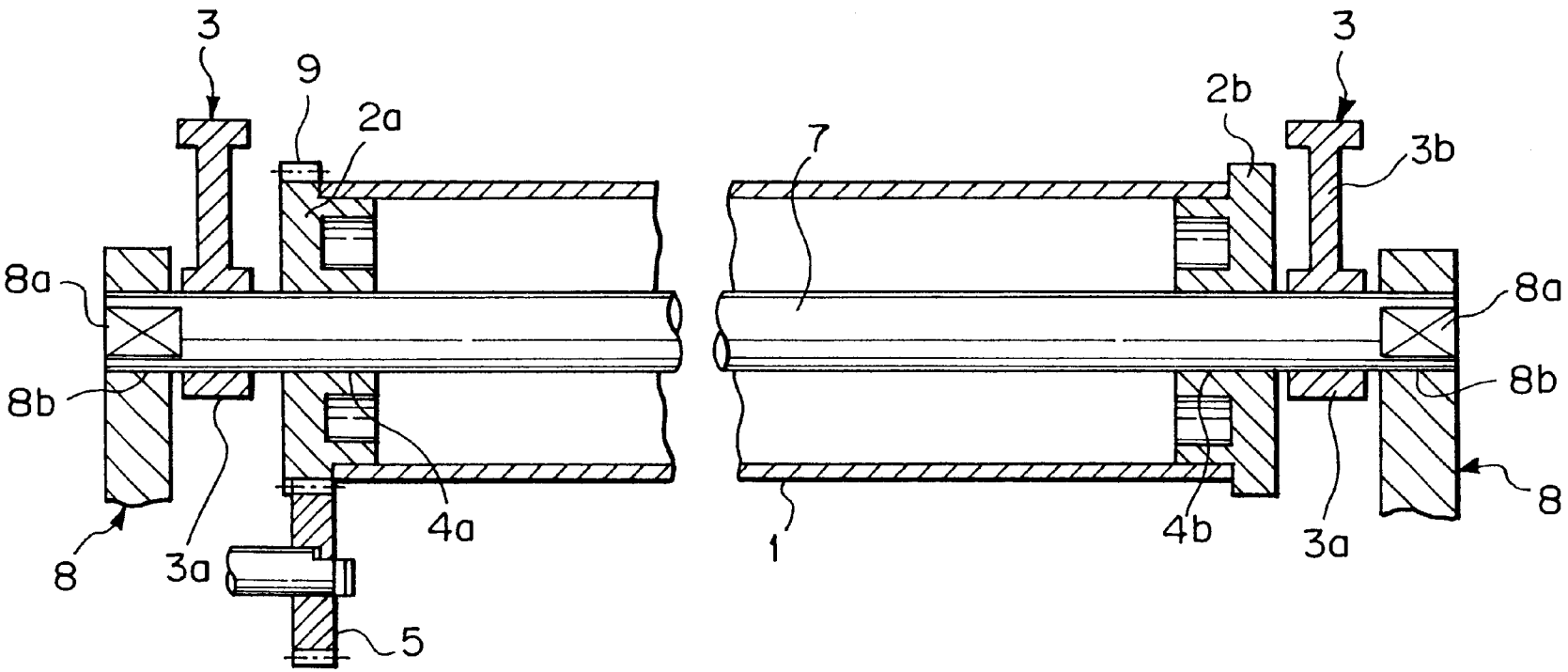

The supporting device embodying the present invention is shown in FIGS. 2 and 3. As shown, a first flange 2*a* is mounted on one end of the drum 1 and is formed with gear teeth 9 in part thereof. A second flange 2*b* is mounted on the other end of the drum 1. The flanges 2*a* and 2*b* respectively have slide portions 4*a* and 4*b* at the center thereof. The shaft 7 extends throughout the slide portions 4*a* and 4*b* so as to rotatably support them thereon. The flanges 2*a* and 2*b* are affixed to the drum 1 by press fitting, electric bonding, adhesion or similar technology.

The shaft 7 has locking members 8 at opposite ends thereof. The locking members 8 each has flat portions 8*a* facing each other and formed by cutting away part of the periphery of the shaft 7 in parallel planes at opposite sides of the axis of shaft 7, and round surfaces 8*b* facing each other and formed by the other or remaining part of the periphery of the shaft 7. The round surfaces 8*b* are perpendicular to the flat surfaces 8*a*. Therefore, each locking member 8 is substantially oval as viewed in a section perpendicular to the axis of the shaft 7. Knobs 3 are respectively mounted on opposite ends of the shaft 7, and each is made up of a portion 3*a* engaged with the shaft 7 and a portion 3*b* to be gripped by hand. The engaging portion 3*a* is affixed to the shaft 7 by, for example, a set screw, split pin or adhesive.

As shown in FIG. 2, the previously mentioned shaft support member 6, mounted on the copier body, is positioned at opposite sides of the shaft 7. Such shaft support members 6 protrude from the hopper 14*a,* and each has an opening 6*a* and a circular hole 6*b* which are communicated to each other. The circular hole 6*b* is engageable with the round surfaces 8*b* of one of the locking members 8. The shaft support members 6 guide the locking members 8 with their guide surfaces 6*c*. While the members 6 are provided on the hopper 14*a* in the illustrative embodiment, they may be provided on, for example, a drum unit or an image transfer unit.

In operation, after the drum 1 has been positioned on the copier body by the above-stated supporting device, a rotating force is transmitted from a drive source, not shown, to the gear teeth 9 of the first flange 2*a* via a gear 5 (FIG. 3). As a result, the drum 1 connected to the flange 2*a* is caused to rotate. At this instant, the shaft 7 remains stationary with the result that the flanges 2*a* and 2*b* rotate about the shaft 7.

Figure 4A:
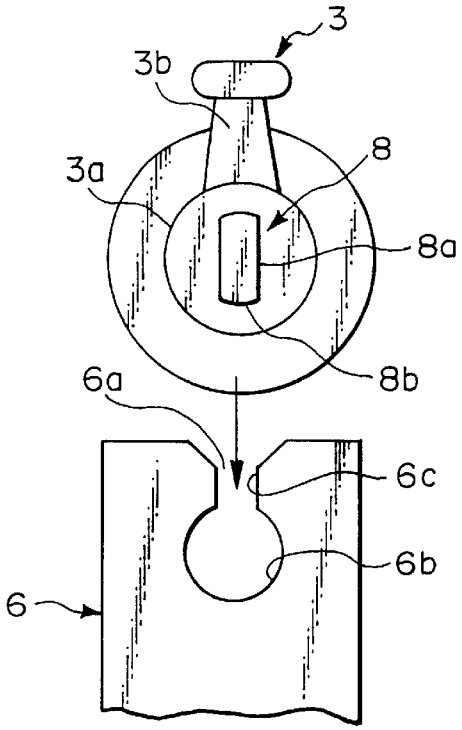
FIG. 4A–4C demonstrate a procedure for assembling the device shown in FIGS. 2 and 3.
Figure 4B:
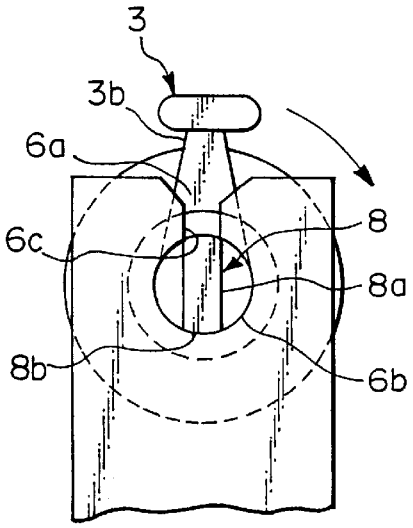
Figure 4C:
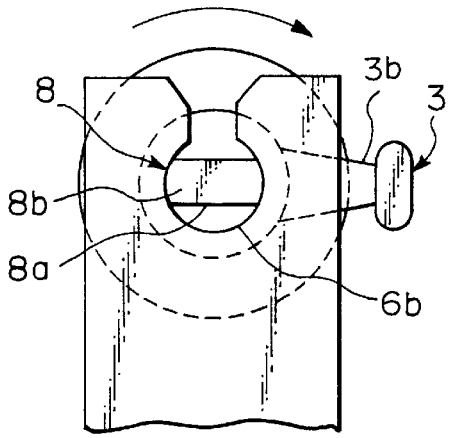

FIGS. 4A–4C show how the locking members 8 are inserted into the respective shaft support members 6 and locked in position. First, FIG. 4A shows a condition wherein the shaft 7 carrying the drum 1 is about to be inserted into the shaft support members 6. At this stage, the shaft 7 is positioned such that the flat surfaces 8*a* of each locking member 8 are parallel to the guide surfaces 6*c* of the opening 6*a* of the shaft support member 6. Subsequently, the locking members 8 are inserted into the respective circular holes 6*b* with the flat surfaces 8*a* being guided by the guide surfaces 6*c,* as shown in FIG. 4B. After the lower round portions of the locking members 8 have respectively abutted against the bottoms of the circular holes 6*b,* the knobs 3 are rotated 90 degrees, as shown in FIG. 4C. As a result, the opposite round surfaces 8*b* are brought into contact with the wall of the associated circular hole 6*b*. The locking members 8 are held in such a position by locking means, not shown. The locking means may be implemented by a spring, leaf spring, friction member or similar mechanical means or by electrical means.

It is noteworthy that the shaft of the conveyor roller 14*d,* contacting the drum 1 under a predetermined pressure, and the shaft support members 6 can be accurately positioned since both of them are provided on the developing unit 14. Further, since the U-shaped portions of the first arms 21, extending from the waste toner tank 18, are engaged with the shaft 7, the shaft 7 is constantly urged downward due to the weight of the tank 18. This successfully enhances the accurate positioning of the drum 1. In addition, the presser member 24 mounted on the top cover 23 of the copier body further enhances the accurate positioning of the drum 1.

As stated above, the illustrative embodiment allows the operator to remove a photoconductive drum from an image forming apparatus together with a shaft thereof rapidly and easily, i.e., without pulling out the shaft from the drum. Also, it is not necessary for the operator to separate the photoconductive drum and shaft at the time of replacement. Further, the operator is successfully prevented from touching the photoconductive surface of the drum or toner left thereon in the event of replacement. Moreover, a new photoconductive drum can be readily positioned when it is mounted to the apparatus.

2nd Embodiment

Figure 5:
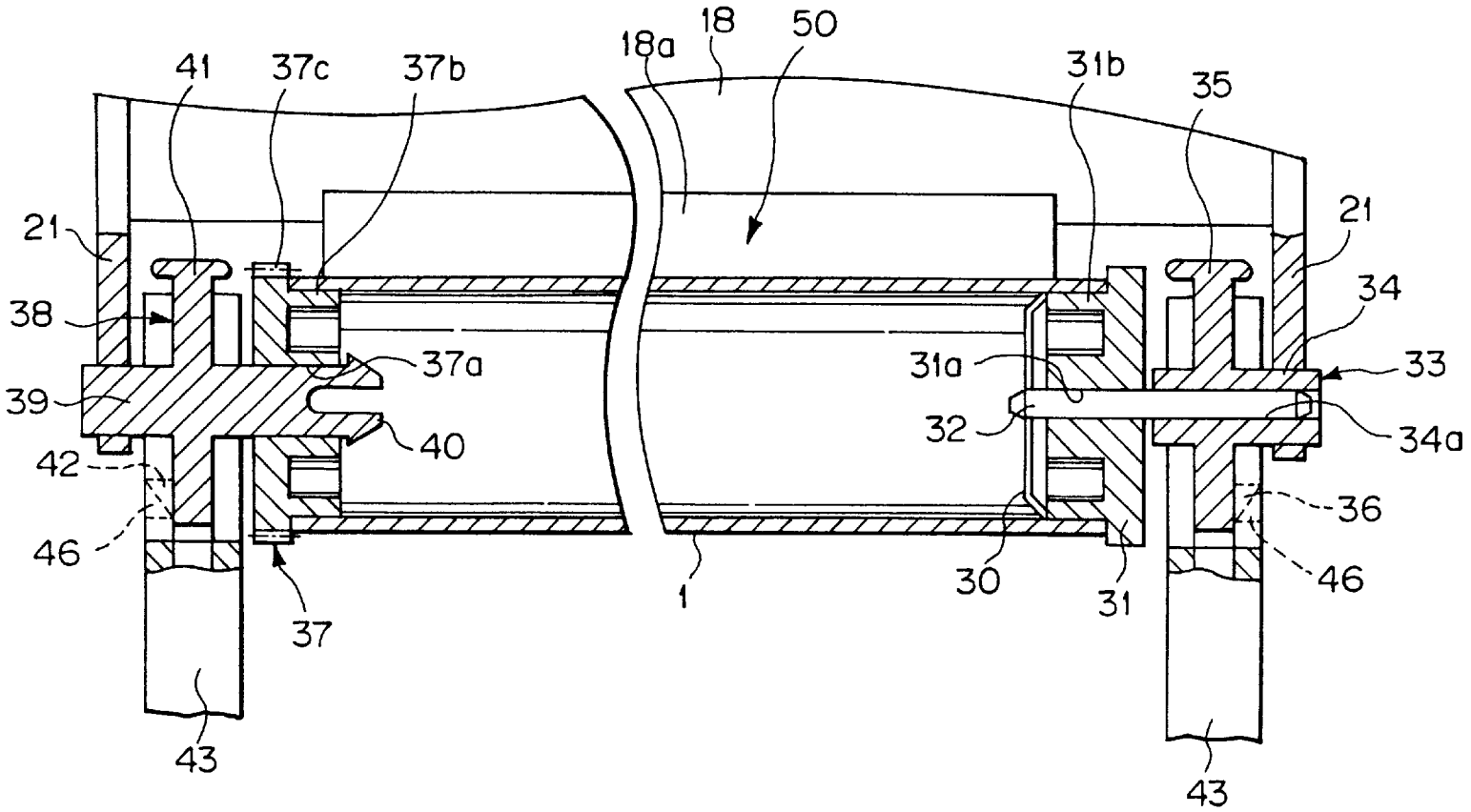
FIGS. 5 and 6 show a second embodiment of the present invention in a section and a perspective view, respectively.
Figure 6:
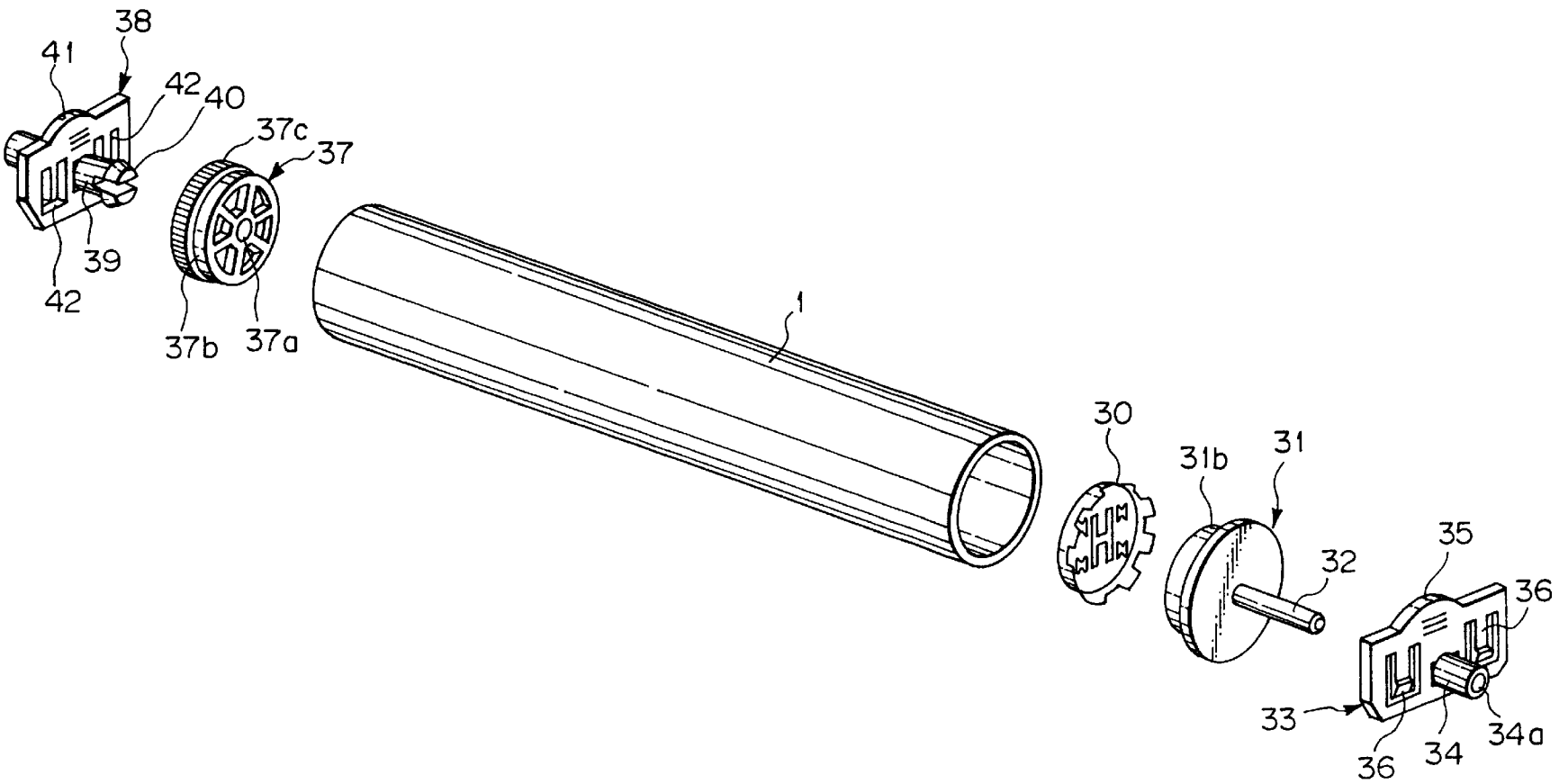
Figure 7:
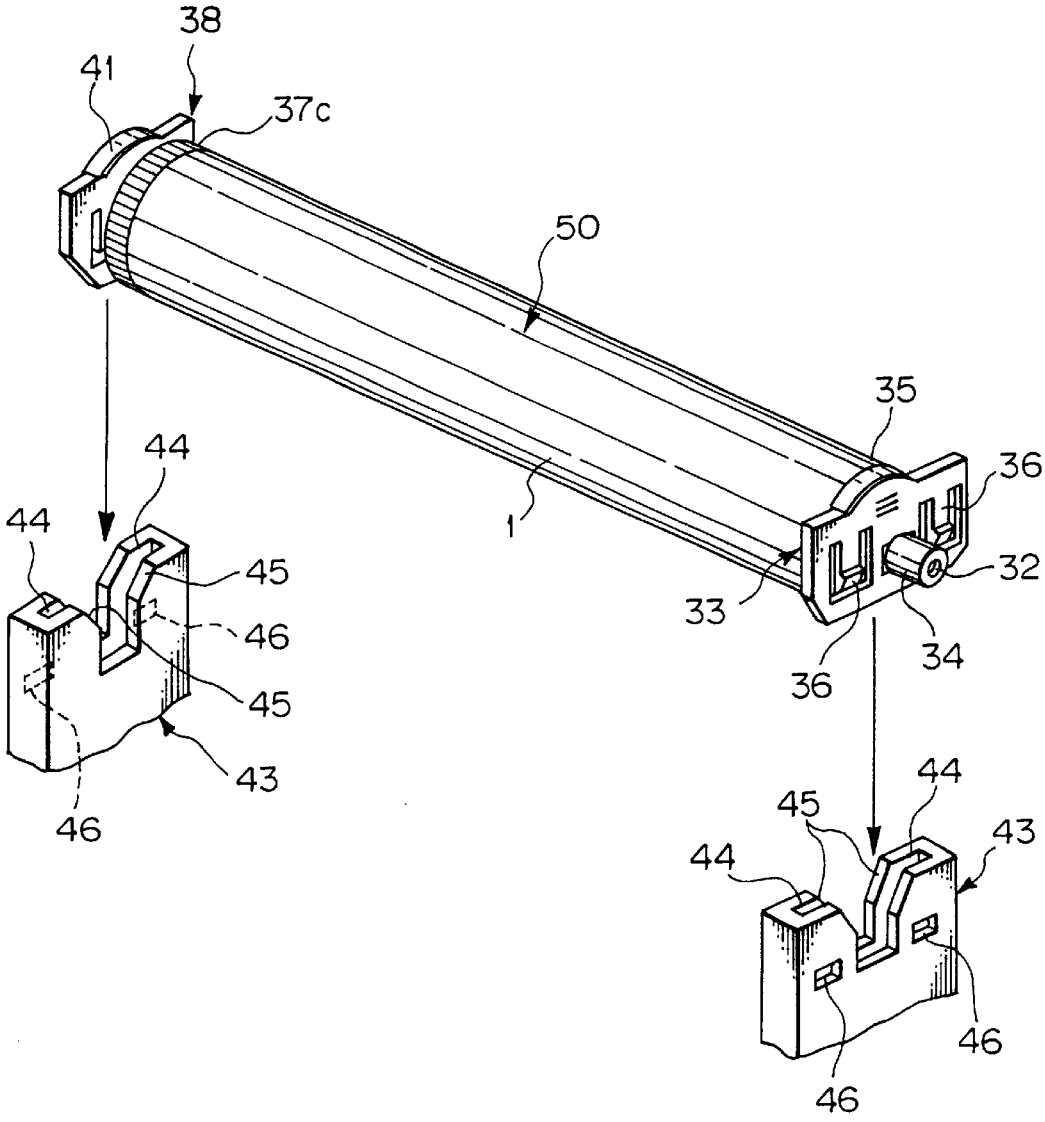
FIG. 7 shows a procedure for assembling the second embodiment.

Referring to FIGS. 5–7, a second embodiment of the present invention will be described which is also applicable to the copier shown in FIG. 1. As shown, a grounding member 30 contacts the inner periphery of the drum at the circumferential edge thereof and is implemented by a thin resilient plate. A first flange 31 is partly received in one of opposite open ends of the drum 1 and is formed with a through bore 31*a* at the center thereof. A conductive shaft 32 extends throughout the bore 31*a* of the flange 31 and remains in contact with the grounding member 30. A bearing member 33 has a tubular projection 34 having a bore 34*a* which rotatably supports the shaft 32, a knob portion 35, and a pair of locking pawls 36 protruding outward. A second flange 37 is partly received in the other open end of the drum 1 and formed with gear teeth 37*c* which receive a rotating force from a gearing, not shown. The gear teeth 37*c* may be formed on the first flange 31, if desired. A shaft member 38 has a shaft portion 39 rotatably supported at one end thereof by a through bore 37*a* formed in the second flange 37, locking pawls 40 formed at one end of the member 38 for surely locking the member 38 to the flange 37, a knob portion 41, and a pair of locking pawls 42 protruding outward.

A pair of support members 43 protrude from the hopper 14*a,* FIG. 1, which forms part of the copier body. Each support member 43 has a groove 44 open at the upper end thereof, an inclined portion 45 for supporting the tubular projection 34 of the bearing member 33 or the other end of the shaft portion 39 of the shaft member 38, and holes 46 for receiving the locking pawls 36 of the bearing member 33 or the locking pawls 42 of the shaft member 38.

The flanges 31 and 37 respectively include circumferential walls 31*b* and 37*b* each having an outside diameter slightly greater than the inside diameter of the drum 1. The walls 31*b* and 37*b* are affixed to the inner periphery of the drum 1 by press fitting. The conductive shaft 32, contacting the ground member 30, protrudes from the flange 31 so as to implement grounding at the outside of the assembly.

FIGS. 5 and 7 show how the above-described assembly, or drum unit, 50 is mounted to the apparatus body. The bearing member 33 and shaft member 38 each has a flat portion which is substantially identical in shape with the groove 44 of each support member 43. When such flat portions of the members 33 and 38 are inserted into the grooves 44 of the respective support members 43, the locking pawls 36 and 42 are received in the holes 46 of the respective support members 43. As a result, the drum unit 50 is accurately positioned on the support members 43. Further, as shown in FIG. 1, the tubular projection 34 of the bearing member 33 and the shaft portion 39 of the shaft member 38 are engaged with the U-shaped ends of the respective first arms 21, playing the role of the drum shaft 7. In this condition, the drum 1 is held in a predetermined horizontal position.

The drum unit 50 can be easily removed from the support members 43 only if it is pulled upward with the knob portions 35 and 41 held by hand until the locking pawls 36 and 42 have been released from the holes 46. The operator, therefore, does not have to remove the constituent parts, except for the drum unit 50, which are the cause of smears.

As stated above, the illustrative embodiment allows the operator to remove a drum unit easily by holding knob portions, while preserving the function of a photoconductive drum. In addition, the number of constituent parts to be removed at the time of replacement is minimized, thereby reducing the running cost of an image forming apparatus.

3rd Embodiment

Figure 8:
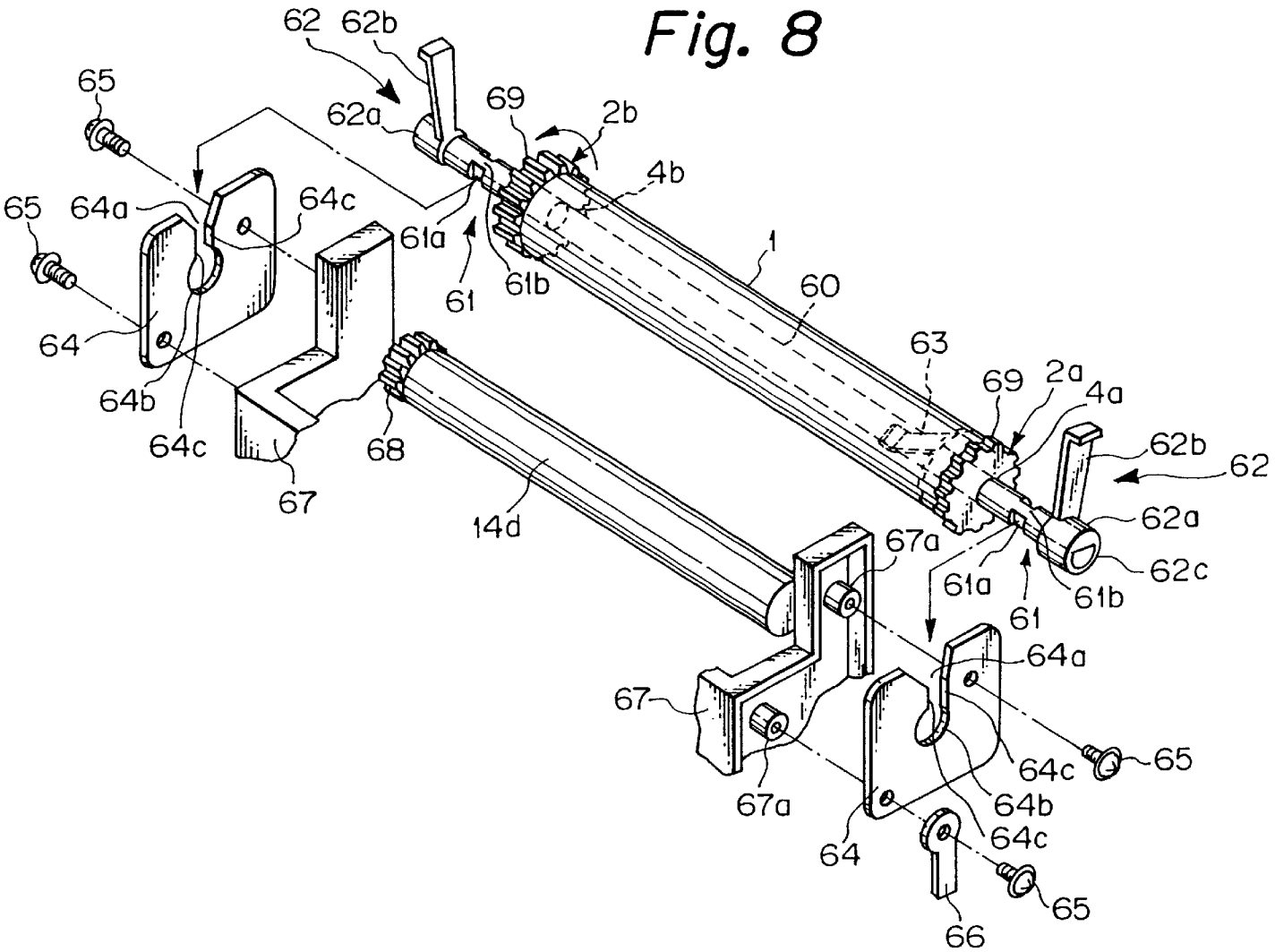
FIG. 8 is a perspective view showing a third embodiment of the present invention.

FIG. 8 is a view showing a third embodiment of the present invention. As shown, the first and second flanges 2*a* and 2*b* are respectively mounted on the opposite ends of the drum 1, and each has the gear teeth 69 formed thereon. A shaft 60 extends throughout the through bores 4*a* and 4*b* formed at the centers of the flanges 2*a* and 2*b*, respectively. In this condition, the walls of the bores or sliding portions 4*a* and 4*b* are rotatable on the shaft 60. The flanges 2*a* and 2*b* are affixed to the drum 1 by press fitting, electrical connection, adhesion, or similar technology. A conductive member 63 is affixed to the flange 2*a* in order to connect the inner periphery of the drum 1 and shaft 60 to ground. Hence, when the drum 1 is exposed imagewise by the optical writing unit 13, the charge deposited on the surface of the drum 1 is released to ground.

The shaft 60 has notched portions 61 at opposite ends thereof. Each notched portion 61 consists of parallel flat portions 61*a* formed by cutting away the shaft 60 in parallel planes at both sides of the axis of the shaft 60, and arcuate portions 61*b* facing each other and contiguous with the circumference of the shaft 60. The arcuate portions 61*b* are deviated 90 degrees from the flat portions 61*a*. Hence, each notched portion 61 has an oval section, as viewed in a plane perpendicular to the axis of the shaft 60. A pair of shaft support members 64 each supports one of the notched portions 61 of the shaft 60. After the drum 1 and intermediate roller 14*d* have been positioned by use of, e.g., a jig such that they are spaced by a predetermined gap or bite into each other in a predetermined amount, the support members 64 are respectively fastened to stationary members 67 by screws 65.

When the distance between the drum 1 and the roller 14*d* or their positions are adjustable, as in the above arrangement, it is possible to adjust the positions even if, e.g., the outside diameter of the roller 14*d* differs from one lot to another lot. In addition, even the fine irregularity of the individual member can be absorbed. Hence, the drum 1 and roller 14*d* can be positioned with a preselected degree of accuracy. Particularly, the roller 14*d* which is elastic cannot be easily provided with an accurate outside diameter; should the above adjustment be unavailable, the position of the roller 14*d* relative to the drum 1 would be inaccurate and would thereby lower the image quality. The shaft support members 64 are each formed with an opening 64*a* for allowing the flat portions 61*a* of the notched portion 61 to pass, and a circular hole 64-*b* communicated to the opening 34*a*.

After the drum 1 has been positioned and supported by the above arrangement, a torque is transmitted from a drive source, not shown, to a drive gear, not shown. Then, the torque is transferred from the drive gear to the gear teeth 69 of the flange 2*a*. As a result, the drum 1 is rotated via the gear teeth 69. At this instant, the shaft 60 is held in a locked position, so that the flanges 2*a* and 2*b* rotate about the shaft 60. Also, the intermediate roller 14*d* is rotated via the gear teeth 69 of the flange 2*b* and gear teeth 68 formed on the roller 14*d* and meshing with the teeth 69.

In a modification of the illustrative embodiment, one or both of the flanges 2*a* and 2*b* is made of a conductive material. As a result, the drum 1 and the shaft 60 connected to ground via the apparatus body are surely connected to ground. This allows the charge to be released from the surface of the drum 1 to ground in the event of exposure.

In another modification of the embodiment, a conductive member, not shown, is fitted on one or both of the flanges 2*a* and 2*b* for connecting the drum 1 and shaft 60 to ground. This also allows the charge to be released from the surface of the drum 1 to ground in the event of exposure.

In still another modification of the embodiment, the shaft support member 64 is made of metal while a ground plate 66 (see FIG. 8) is fastened to the support member 64 and connected to ground via the apparatus body. When the shaft 60 is supported by the support plate 64, the shaft 60 and drum 1 are surely connected to ground via the apparatus body.

In a further modification of the embodiment, the shaft support member 64 is made of a conductive material while the ground plate 66 is fastened to the support member 64 and connected to ground via the apparatus body. When the shaft 60 is supported by the support plate 64, the shaft 60 and drum 1 are surely connected to ground via the apparatus body.

As stated above, when the drum 1 and shaft 60 are electrically connected to each other and the support member 64 is conductive, the drum 1 is connected to ground via the apparatus body. This automatically completes grounding when the shaft 60 is mounted to the support member 64.

In an additional modification of the embodiment, handles 62 are provided on both ends of the shaft 60 outside of the arcuate portions 61*b*, As shown in FIG. 8, the handles 62 each consists of a portion 62*a* fitted on the shaft 60, and a grip portion 62*b* which may be gripped by hand. The portion 62*a* is formed with a through bore 62*c* having a D-shaped cross-section. The end of the shaft 60 is also cut in the form of a letter D and press-fitted in the bore 62*c*. This press-fitting scheme may be replaced with a stop screw, split pin or adhesive, if desired. The handles 62 allow the operator to mount or dismount the drum 1 without touching the drum 1. This frees the drum 1 from contamination and scratches while freeing the operator from smears.

Figure 9:
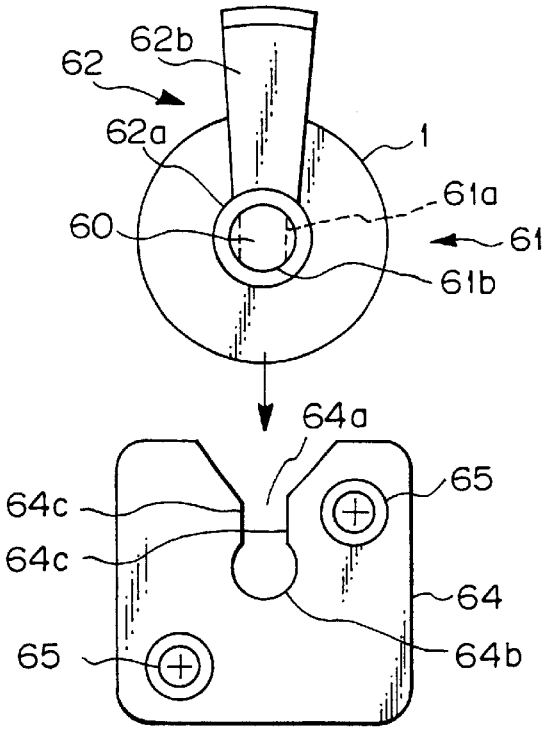
FIGS. 9–11 demonstrate a procedure for assembling the third embodiment.
Figure 10:
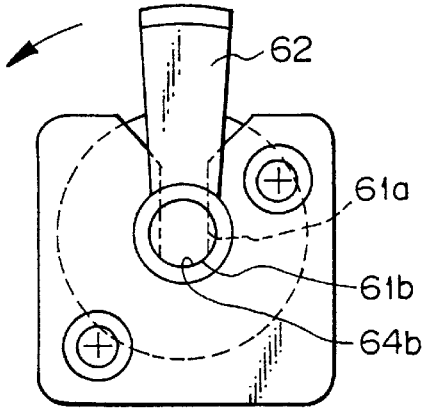
Figure 11:
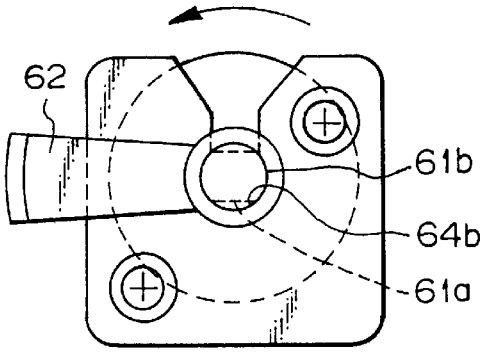

FIGS. 9–11 demonstrate how each of the notched portions 61 is inserted into the associated support member 64 and locked in place. First, as shown in FIG. 9, the notched portion 61 is positioned such that the flat portions 61*a* are parallel to guide surfaces 64*c* included in the support member 64. Then, as shown in FIG. 10, the notched portion 61 is inserted into the circular hole 64*b* via the opening 64*a* until the lower arcuate portion 61*b* abuts against the wall of the hole 64*b*. At this instant, the flat portions 61*a* are guided by the guide surfaces 64*c*. Subsequently, as shown in FIG. 11, the handle 62 is rotated 90 degrees with the result that the opposite arcuate portions 61*b* contact the wall of the hole 64*b*. Consequently, the shaft 60 is positioned by and locked to the support member 64.

In the above condition, some clearance or play exists between the arcuate portions 61*b* and the wall of the hole 64*b*. However, because the shaft 60 is pressed downward due to the weight of the waste toner tank 18 via the first arm 21, the arcuate portions 61*b* and the wall of the hole 64*b* tightly contact each other. This frees the drum 1 from play and prevents the positioning accuracy from being deteriorated. In addition, because the cover plate 23 presses the waste toner tank 18 downward via the presser 24, the tank 18 is also fixed in place in the up-and-down direction. As a result, the play of the drum 1 is fully obviated.

The 90 degrees of rotation of each handle 62 is only illustrative and may be replaced any other desired angle so long as the shaft 60 can be fixed in place. After the handles 62 have been rotated 90 degrees, they are locked by a spring, leaf spring, friction body or mechanical or electrical locking implementation.

4th Embodiment

Figure 12:
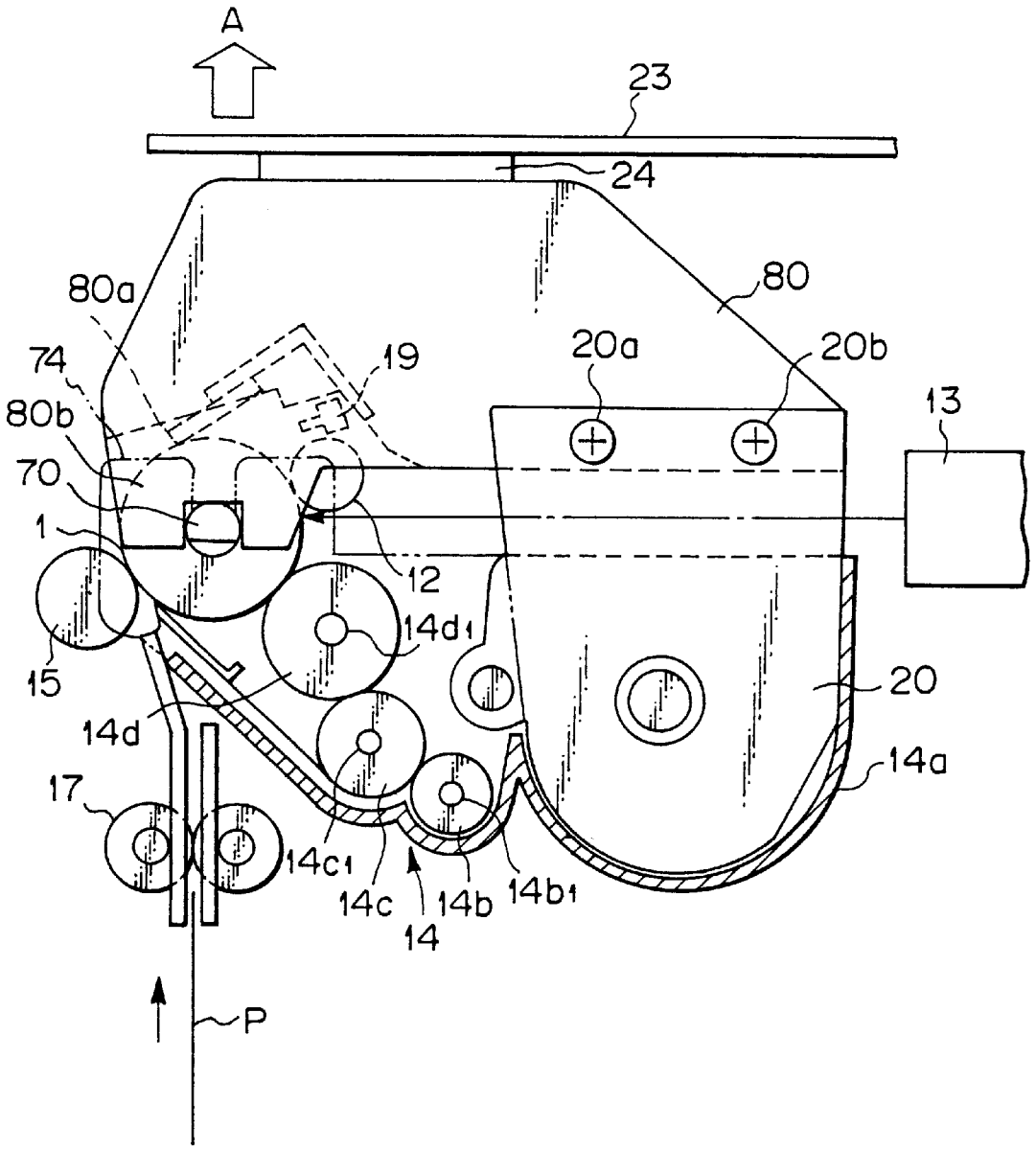
FIG. 12 is a fragmentary section of an image forming apparatus to which a fourth embodiment of the present invention is applied.

FIG. 12 shows an essential part of an image forming apparatus to which a fourth embodiment of the present invention is applied. In the embodiment to be described, the same or similar constituents as or to the constituents of any one of the previous embodiments are designated by the same reference numerals, and a detailed description thereof will not be made in order to avoid redundancy.

As shown in FIG. 12, the drum 1 is mounted on a shaft 70 which is supported by a shaft support member 74. The support member 74 is affixed to a preselected portion of the hopper 14*a,* not shown. If desired, the support member 74 may be affixed to a drum unit, image transfer unit, fixing unit, or apparatus body, as in the previous embodiment.

A waste toner tank 80 is disposed above and in close proximity to the drum 1. A cleaning blade, or cleaning means, 80*a* is mounted on the tank 80 in order to scrape off the toner remaining on the drum 1 after the image transfer. A pair of engaging portions 80*b* are formed at both ends of the tank 80 in the right-and-left direction, and each includes a notch. The notches of the engaging portions 80*b* respectively mate with tank support portions, not shown, formed at opposite ends of the shaft 70. As a result, the tank 80 is accurately positioned relative to the drum 1 and held in a preselected operative position.

The waste toner tank 80 and fresh toner tank 20 are fastened to each other by screws 20*a* and 20*b,* thereby constituting a single unit. To replace the drum 1, the tank 80 is lifted with the tank 20 serving as a fulcrum, so that a space above the drum 1 is opened. Then, the drum 1 is lifted in the direction indicated by an arrow A until the shaft 70 has been released from the shaft support portions 74.

Figure 13:
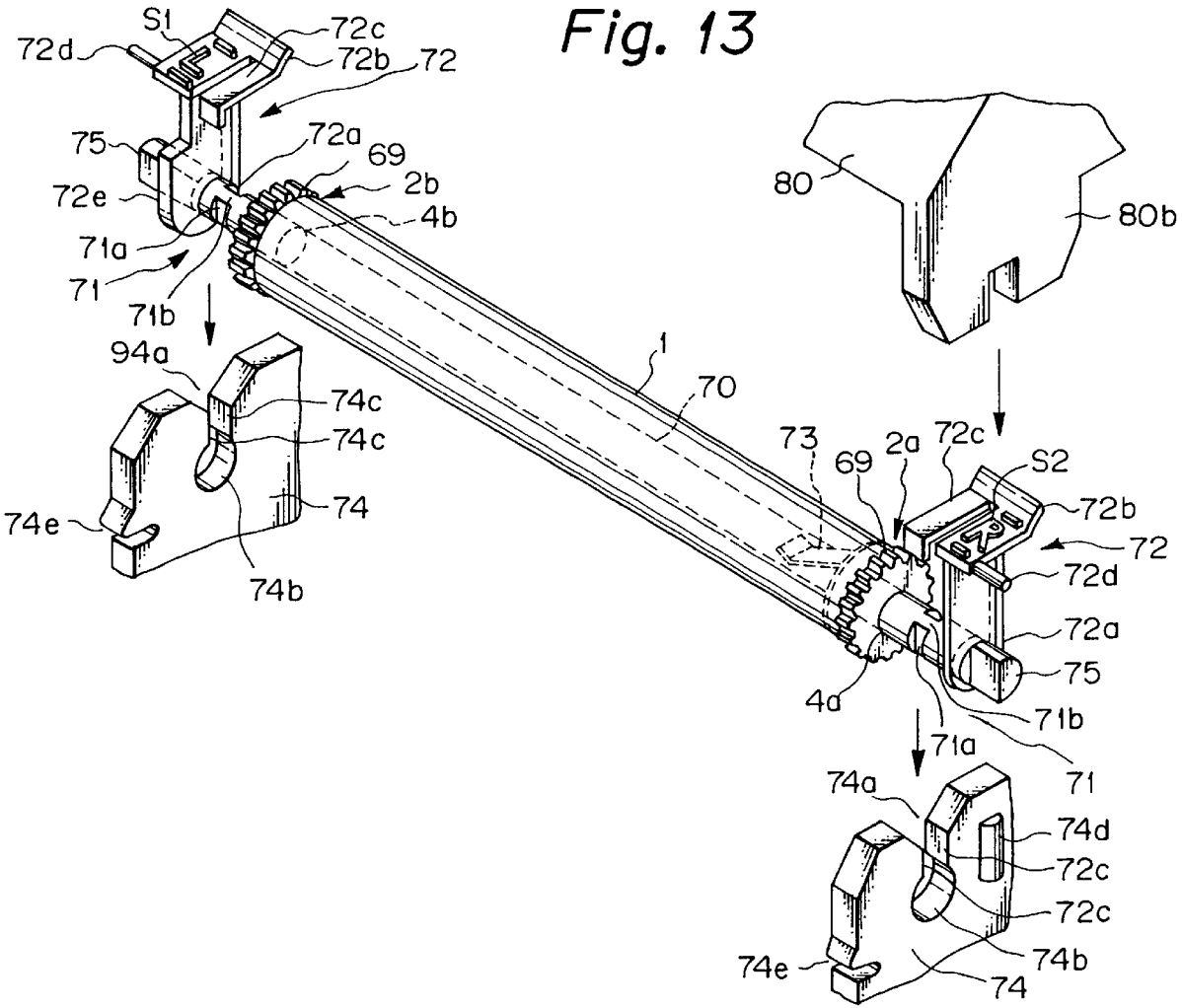
FIG. 13 is a perspective view of the fourth embodiment.

FIG. 13 shows the above image carrier supporting device more specifically. As shown, the first and second flanges 2*a* and 2*b* are respectively mounted on the right and left ends of the drum 1, and each has the gear teeth 69 formed thereon. A shaft 70 extends throughout the through bores or sliding portions 4*a* and 4*b* formed at the centers of the flanges 2*a* and 2*b,* respectively. In this condition, the walls of the bores 4*a* and 4*b* are rotatable on the shaft 70. The flanges 2*a* and 2*b* are affixed to the drum 1 by press fitting, electrical connection, adhesion, or similar technology. A conductive member 73 is affixed to the flange 2*a* in order to connect the inner periphery of the drum 1 and shaft 60 to ground. Hence, when the drum 1 is exposed imagewise by the optical writing unit 13, the charge deposited on the surface of the drum 1 is released to ground.

The shaft 70 has notched portions 71 at opposite ends thereof. Each notched portion 71 consists of parallel flat portions 71*a* formed by removing the shaft 70 in parallel planes at both sides of the axis of the shaft 70, an arcuate portions 71*b* contiguous with the circumference of the shaft 70. The arcuate portions 71*b* face each other while being deviated 90 degrees from the flat portions 71*a*. Hence, each notched portion 71 has an oval section, as viewed in a plane perpendicular to the axis of the shaft 70. A pair of shaft support members 74 each supports one of the notched portions 71 of the shaft 70. In the illustrative embodiment, the support members 74 extend out from the side walls of the hopper 14*a*.

The shaft support members 74 are each formed with an opening 74*a* for allowing the flat portions 71*a* of the notched portion 71 to pass, and a circular hole 74*b* communicated to the opening 74*a*. The notched portion 71 is inserted into the hole 74*b* via the opening 74*a*. Then, the shaft 70 is rotated a predetermined angle, so that the arcuate portions 71*b* contact the wall of the hole 74*b*. As a result, the drum 1 supported by the shaft 70 is accurately positioned.

After the drum 1 has been positioned and supported by the above arrangement, a torque is transmitted from a drive source, not shown, to a drive gear, not shown. Then, the torque is transferred from the drive gear to the gear teeth 69 of the flange 2*a*. As a result, the drum 1 is rotated via the gear teeth 69. At this instant, the shaft 70 is held in a locked position, so that the flanges 2*a* and 2*b* rotate about the shaft 70.

Handles 72 are provided on opposite ends of the shaft 70 outside of the arcuate portions 71*b*. The handles 72 each consists of a portion 72*a* fitted on the shaft 70, and a grip portion 72*b* which may be gripped by hand. The portion 72*a* is formed with a through bore having a D-shaped cross-section. The end of the shaft 70 has a portion 75 cut in the form of a letter D and has the portion 75 press-fitted in the D-shaped bore of the portion 72*a*. This press-fitting scheme may be replaced with a stop screw, split pin or adhesive, if desired. It is to be noted that the D-cut ends 75 of the shaft 70 serve as waste toner tank support portions with which the waste toner tank engage, as will be described.

The handles 72 allow the operator to mount or dismount the drum 1 without touching the drum 1. This frees the drum 1 from contamination and scratches while freeing the operator from smears.

Each handle 72 further includes a pawl 72*c* while each shaft support member 74 further includes a locking portion 74*e*. When the handle 72 is rotated approximately 90 degrees, the tip of the pawl 72*c* snaps into a notch included in the locking portion 74*e,* as will be described more specifically later. A lug adjoining the notch of the locking portion 74*e* causes the pawl 72*c* to resiliently warp before the pawl 72*c* mates with the recess. This provides an adequate degree of resistance against the manipulation. At the moment when the pawl 72*c* snaps into the recess due to the energy stored therein, the operator can feel the snapping or clicking. This allows the operator to easily recognize the mounting of the drum 1. The pawl 72*c* and locking portion 74*e* do not increase the number of parts because they are formed integrally with the handle 72 and support member 74, respectively.

Symbols S1 and S2 representative of "right" and "left", i.e., letters R and L are respectively formed on the portions 72*b* of the right and left handles 72 in relief. The symbols S1 and S2 allow the operator to identify the orientation of the drum 1 by intuition and mount it in a correct position. Moreover, because the letters R and L are in relief, they prevent the operator's hands from slipping when gripping the handles 42.

The portion 72*a* of the left handle 72 has a width, in the direction perpendicular to the axis of the drum 1, which is greater at the front side (left-hand side in FIG. 13) than at the rear side (right-hand side in FIG. 13), thereby forming an interference 72-*e*. The right shaft support member 74 has an interference in the form of a lug 74*d* at the rear of the hole 74*b*. So long as the drum 1 is mounted in the correct orientation in the right-and-left direction, the interference 72*e* and lug 74*d* do not interfere with each other. However, the interference 72*e* and lug 74*d* abut against each other if the drum 1 is mounted in the opposite orientation. This prevents the drum 1 from being mounted in the incorrect position. The interference 72*e* and lug 74*d* do not increase the number of parts because they are formed integrally with the handle 72 and support member 74, respectively.

After the shaft 70 has been held by the support members 74, the waste toner tank 80 disposed above the shaft 70 is lowered and set in its preselected position. In this condition, the right engaging portion 80*b*, FIG. 13, and a left-engaging portion, not shown, included in the tank 80 respectively mate with the right and left D-cut ends 75 of the shaft 70 adjoining the handles 72. It is likely that the shaft 70 has not been accurately received in the support members 44, i.e., the drum 1 has not been accurately positioned when the tank 80 is lowered toward the shaft 70. In light of this, the right and left handles 72 are each provided with an interference or projection 72*d* extending outward in the axial direction of the shaft 70, as will be described specifically later.

Figure 14:
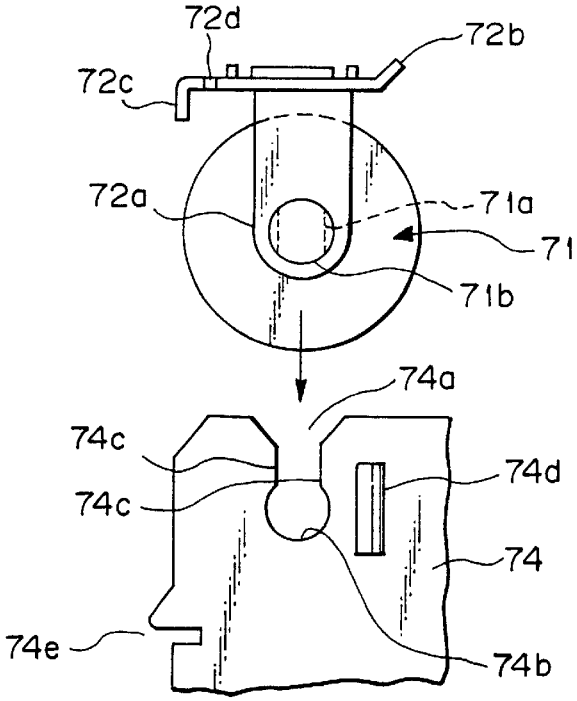
FIG. 14–16 demonstrate a procedure for assembling the fourth embodiment.
Figure 15:
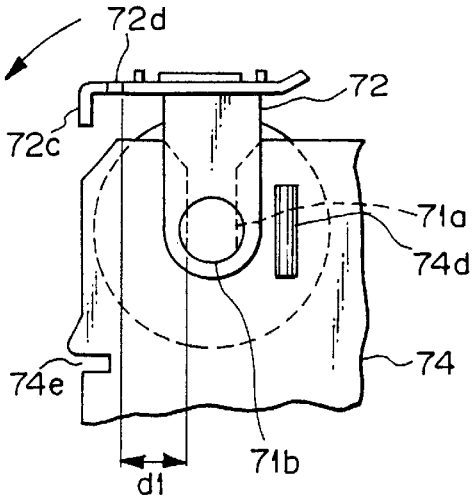
Figure 16:
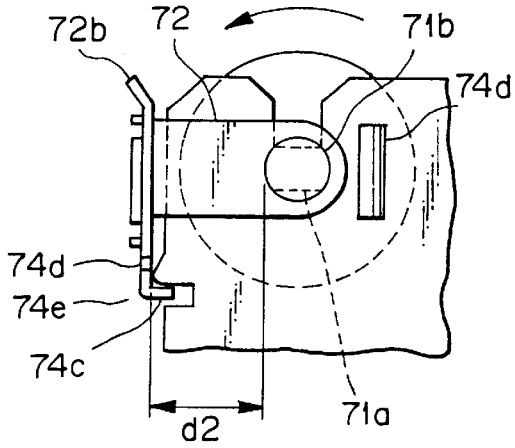

FIGS. 14–16 demonstrate how each of the notched portions 7 is inserted into the associated support member 74 and locked in place. Although the following description concentrates on the right portion of the support device, it is also true with the left portion of the same.

First, as shown in FIG. 14, the notched portion 71 is positioned such that the flat portions 71*a* are parallel to guide surfaces 74*c* included in the support member 74. Then, as shown in FIG. 15, the notched portion 71 is inserted into the circular hole 74*b* via the opening 74*a* until the lower arcuate portion 71*b* abuts against the edge of the hole 74*b*. At this instant, the flat portions 71*a* are guided by the guide surfaces 74*c*. Subsequently, as shown in FIG. 16, the handle 72 is rotated 90 degrees with the result that the opposite arcuate portions 71*b* contact the wall of the hole 74*b*. At this instant, the pawl 72*c* snaps into the recess of the locking portion 74*e*, preventing the handle 72 from being further turned.

By the above procedure, the shaft 70 is positioned by the support member 74. Some clearance or play exists between the arcuate portions 71*b* and the wall of the hole 74*b*. However, because the shaft 70 is pressed downward due to the weight of the waste toner tank 80, the arcuate portions 71*b* and the wall of the hole 74-*b* tightly contact each other. This frees the drum 1 from play and prevents the positioning accuracy from being deteriorated. In addition, because the cover plate 23 presses the waste toner tank 80 downward via the presser 24, the tank 80 is also fixed in place in the up-and-down direction. As a result, the play of the drum 1 is fully obviated. The 90 degrees of rotation of each handle 72 is only illustrative and may be replaced any other desired angle so long as the shaft 70 can be fixed in place.

Figure 17:
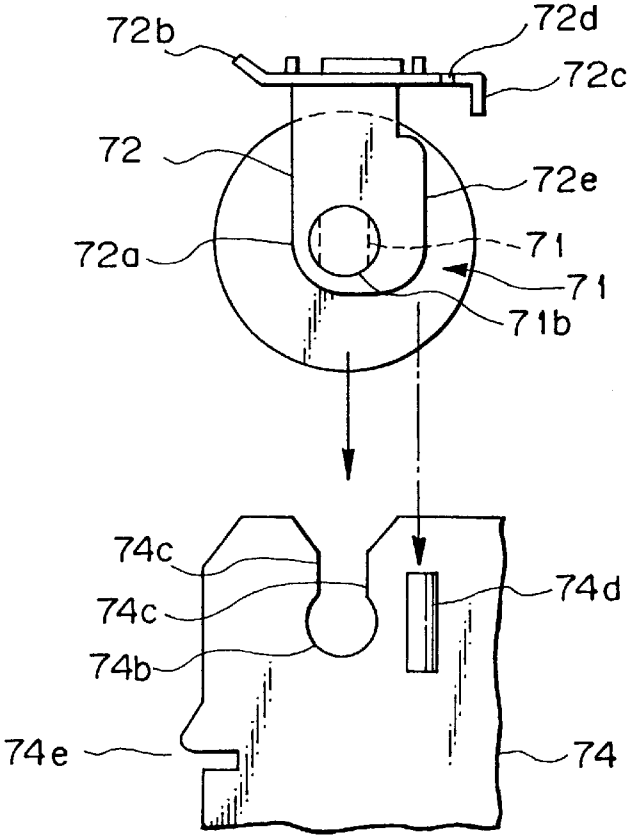
FIG. 17 shows a condition wherein a photoconductive element is mounted in the opposite orientation in the fourth embodiment.

FIG. 17 demonstrates a condition wherein the operator is about to mount the drum 1 in the opposite orientation in the right-and-left direction by accident. In FIG. 17, there are shown the left handle 72, as viewed in FIG. 13, and the right support member 74, as also viewed in FIG. 13. In this condition, the interference 72*e* and lug 74*d* of the left handle 72 and right support member 74, respectively, abut against each other and successfully prevent the operator from mounting the drum 1 in the opposite orientation. Of course, the right handle 72 and left support member 74 may be formed with the interference 72*e* and lug 74*d*, respectively. Further, to obviate the opposite orientation of the drum 1 more positively, both of the right and left handles 72 and both of the right and left support members 74 may be provided with the interferences 72*e* and interferences 74*d*, respectively.

A condition wherein the operator is about to inadvertently lower the waste toner tank 80 toward the drum 1 held in an incomplete position will be described with reference to FIG. 18. Although the following description concentrates on the right portion of the support device, it is also true with the left portion of the same.

After the shaft 70 has been received in the support member 74 to thereby position the drum 1, the waste toner tank 80 is lowered to its preselected position, as stated earlier. In this case, the engaging portion 80*b* of the tank 80 mates with the D-cut end 75 of the shaft 70 adjoining the handle 72.

Figure 18:
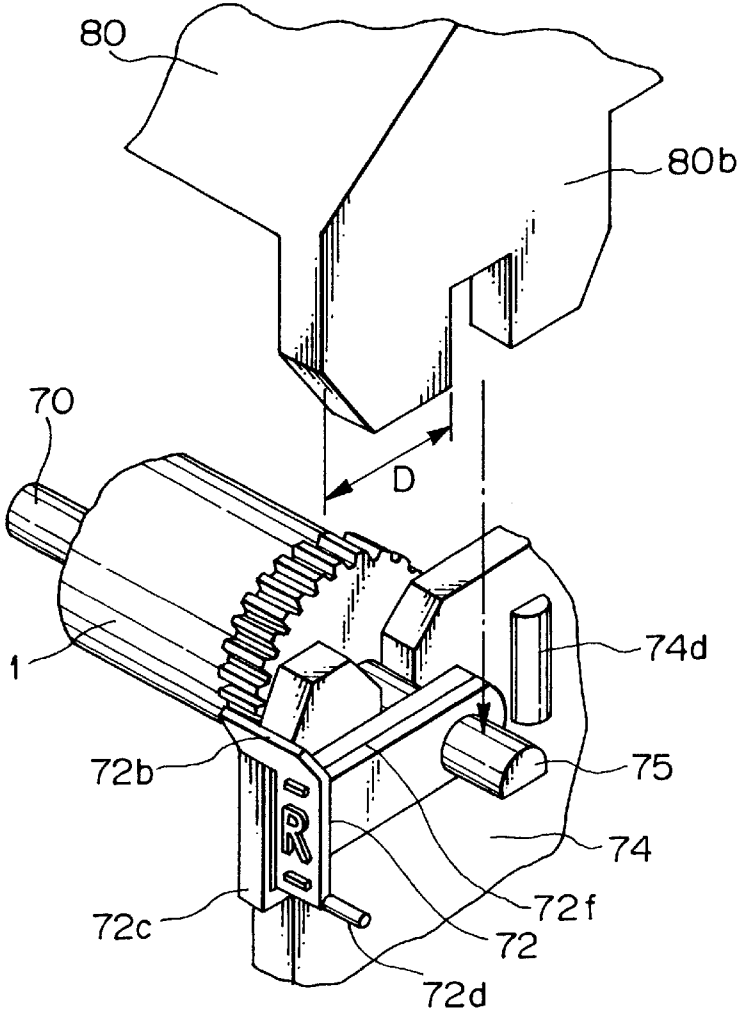
FIG. 18 shows how a waste toner tank is set in the fourth embodiment.

FIG. 18 shows a condition wherein the shaft 70 is held by the support member 74 in its complete position. In this case, as shown in FIG. 16, the distance between the interference 72*d* and the D-cut end 75 of the shaft 70 is d2 in the front-and-rear direction. On the other hand, as shown in FIG. 15, when the shaft 70 is not fully locked to the support member 74, the distance between the interference 72*d* and the D-cut end of the shaft 70 is d1.

The front part, or projection, of the engaging portion 80*b* of the tank 80 with respect to the notch has a width D in the front-and-rear direction. The illustrative embodiment sets up a relation $d1<D<d2$. Hence, if the shaft 70 is fully locked to the support member 74, the engaging portion 80*b* can mate with the D-cut end 75 of the shaft 70; if otherwise, the projection or interference 72*d* abuts against the engaging portion 80*b* and prevents it from mating with the end 75 of the shaft 70. This obviates the incomplete mounting of the drum 1 and tank 80.

Further, as shown in FIG. 18, when the shaft 70 is locked in the above accurate position, a rounded edge included in the handle 72 faces upward. Hence, when the tank 80 is lowered after the drum 1 has been mounted, the engaging portion 80*b* of the tank 80 can be smoothly brought into engagement with the D-cut end 75 of the shaft 70 without being caught by the handle 72. This facilitates the setting of the tank 80.

In summary, it will be seen that the present invention provides an image carrier support device for an image forming apparatus and having various unprecedented advantages, as enumerated below.

(1) In the event of replacement, a photoconductive element can be rapidly and easily dismounted together with its shaft, i.e., without having the shaft pulled out or inserted. This enhances easy replacement. Further, the operation is simple because the photoconductive element and shaft do not have to be handled independently of each other.

(2) The shaft supporting the photoconductive element is locked to stationary members via shaft support members, so that the element and an intermediate roller for development can be accurately positioned relative to each other. Hence, although the outside diameter of the intermediate roller may differ from one lot to another lot, the adjustment of the relative position can accommodate such a scattering. This, coupled with the fact that even the fine irregularity of the individual member can be absorbed, insures accurate positioning and, therefore, stable image quality.

(3) Because flanges are formed of a conductive material, the photoconductive element is surely connected to ground via the flanges, shaft and apparatus body. Hence, in the event of exposure, charge deposited on the photoconductive element is surely released to ground. This also guarantees stable image quality.

(4) A conductive member is fitted on one of the flanges for electrically connecting the photoconductive element and shaft. The conductive member surely connects the photoconductive element to ground via the shaft and apparatus body. Hence, the charge deposited on the photoconductive element in the event of exposure is surely released to ground. This also guarantees stable image quality.

(5) The shaft support members are made of a conductive material and electrically connect the shaft of the photoconductive element to the apparatus body. This surely connects the photoconductive element to ground and thereby surely releases the charge of the surface of the element to ground in the event of exposure. This also guarantees stable image quality.

(6) The shaft support members are made of a conductive resin and electrically connect the shaft of the photoconductive element to the apparatus body and thereby surely connects the photoconductive element to ground. Further, the support members are free from rust and corrosion. In addition, the support members reduce the cost and weight of the support device because they can be produced by molding.

(7) In the event of replacement, the operator does not have to touch the surface of the photoconductive element. Further, the photoconductive element can be readily guided to its preselected mounting position. In addition, the operator's hands are free from smears.

(8) A pawl included in at least one of the handles snaps into a locking portion included in the shaft support members, thereby preventing the shaft from moving when the photoconductive element is rotated. Hence, the photoconductive element is surely positioned and locked.

(9) Symbols are provided on the handles for the identification of the right-and-left orientation of the photoconductive element. The symbols allow the operator to mount the photoconductive element in an expected orientation without fail.

(10) When the operator grips the handles to rotate them, the above symbols prevent the operator's hands from slipping and thereby promotes easy and sure replacement.

(11) At least one of the handles and at least one of the shaft support portions are each formed with an interference. When the photoconductive element is opposite in orientation in the right-and-left direction, the above interferences abut against each other and prevent it from being mounted in the opposite orientation.

(12) Projections, or interferences, are also provided on the handles. When the photoconductive element is not completely locked in place, the above projections prevent the waste toner tank from being lowered to its preselected position. This frees the photoconductive element and waste toner tank from inaccurate mounting.

(13) When the waste toner tank is lowered, rounded edges included in the handles face upwards. Hence, engaging portions included in the tank are smoothly mounted to the shaft by being guided by the rounded edges.

Various modifications will become possible for those skilled in the art after receiving the teachings of the present disclosure without departing from the scope thereof.

What is claimed is:

1. A device for supporting an image carrier included in an image forming apparatus and implemented as a photoconductive drum, said device comprising:

a shaft supporting said photoconductive drum at an axis of said photoconductive drum;

a pair of flanges respectively affixed to opposite ends of said photoconductive drum, and each being formed with a bearing hole at a center thereof, said shaft extending throughout said bearing hole to allow said each flange to slide thereon;

a pair of locking members formed in the shaft at opposite ends of said shaft, and each comprising flat surfaces facing each other and formed by cutting away part of a periphery of the end of said shaft in parallel planes at opposite sides of the axis, and round surfaces facing each other and formed by the other part of said periphery;

a pair of shaft support members of respectively holding said pair of locking members, and each comprising an opening dimensioned to pass respective flat surfaces of the shaft when the shaft is oriented so that the parallel planes are perpendicular to the opening and to block the round surfaces when the shaft is oriented with the parallel surfaces parallel to the opening, and a circular hole communicated to said opening for engaging with said round surfaces of said respective locking member upon passing of the flat surfaces through the opening, and a pair of knob members respectively provided on the opposite ends of said shaft.

2. A device as claimed in claim 1, further comprising gear teeth formed on an outer periphery of one of said flanges for transmitting a rotating force to said photoconductive drum.

3. A device as claimed in claim 1, wherein said shaft support members each further comprises guide surfaces for guiding said flat surfaces of said respective locking member.

4. A device as claimed in claim 1, wherein said shaft support members form part of a developing unit included in said image forming apparatus.

5. A device for supporting an image carrier included in an image forming apparatus and implemented as a photoconductive drum, said device comprising:

a pair of flanges respectively affixed to opposite ends of said photoconductive drum;

a conductive shaft press fitted in a through bore formed in a center of one of said pair of flanges, while partly protruding from said through bore;

a shaft support member rotatably supporting said conductive shaft;

a first positioning member for positioning said photoconductive drum by holding said shaft support member;

a flange support member rotatable supporting the other flange; and a second positioning member for positioning said photoconductive drum by holding said flange support member;

wherein said shaft support member comprises, a tubular portion having a bore in which said conductive shaft is rotatably received, locking pawls for mating with an engaging portion included in said first positioning member, and knobs for mounting and dismounting said photoconductive drum from said first positioning member.

6. A device as claimed in claim 5, wherein said first positioning member comprises:

a groove open at an upper end thereof;

holes constituting said engaging portion for mating with said locking pawls of said shaft support member; and an inclined portion for supporting said tubular portion of said shaft support member.

7. A device as claimed in claim 5, wherein said flange support member comprises:

a shaft portion rotatably received in a through bore formed in a center of said other flange;

locking pawls for mating with an engaging portion included in said second positioning member;

and knobs for mounting and dismounting said photoconductive drum from said second positioning member.

8. A device as claimed in claim 7, wherein said second positioning member comprises:

a groove open at an upper end thereof;

holes for mating with said locking pawls of said flange support member; and an inclined portion for supporting said shaft portion of said flange support member.

9. A device as claimed in claim 5, further comprising a grounding member contacting an inner periphery of said photoconductive drum and said conductive shaft.

10. A device as claimed in claim 5, further comprising gear teeth formed on an outer periphery of one of said flanges for transmitting a rotating force to said photoconductive drum.

11. An image forming apparatus comprising:

a photoconductive drum; and a device for supporting said photoconductive drum;

said device comprising:

a shaft supporting said photoconductive drum at an axis of said photoconductive drum, a pair of flanges respectively affixed to opposite ends of said photoconductive drum, and each being formed with a bearing hole at a center thereof, said shaft extending throughout said bearing hole to allow said each flange to slide thereon;

a pair of locking members formed in the shaft at opposite ends of said shaft, and each comprising flat surfaces facing each other and formed by cutting away part of a periphery of the end of said shaft in parallel planes at opposite sides of the axis, and round surfaces facing each other and formed by the other part of said periphery;

a pair of shaft support members for respectively holding said pair of locking members, and each comprising an opening dimensioned to pass respective flat surfaces of the shaft when the shaft is oriented so that the parallel planes are perpendicular to the opening and to block the round surfaces when the shaft is oriented with the parallel surfaces parallel to the opening, and a circular hole communicated to said opening for engaging with said round surfaces of said respective locking member upon passing of the flat surfaces through the opening; and a pair of knob members respectively provided on the opposite ends of said shaft.

12. An apparatus as claimed in claim 11, further comprising a developing unit for developing a latent image electrostatically forced on said photoconductive drum by toner, said shaft support members forming part of said developing unit.

13. An apparatus as claimed in claim 12, further comprising a conveyor roller held in contact with said photoconductive drum for conveying the toner from said developing unit to said photoconductive drum, said conveyor roller being supported by said developing unit via a shaft.

14. An apparatus as claimed in claim 11, further comprising:

a waste toner tank for collecting toner left on said photoconductive drum after image transfer; and arm members extending from said waste toner tank and engaged with said shaft at free ends thereof for thereby constantly urging said shaft downward due to a weight of said waste toner tank.

15. An apparatus as claimed in claim 14, further comprising a presser member mounted on a top cover of said apparatus for pressing said waste toner tank downward when said top cover is closed.

16. An image forming apparatus comprising:

a photoconductive drum; and a device for supporting said photoconductive drum;

said device comprising:

a pair of flanges respectively affixed to opposite ends of said photoconductive drum;

a conductive shaft press fitted in a through bore formed in a center of one of said pair of flanges, while partly protruding from said through bore;

a shaft support member rotatably supporting said conductive shaft;

a first positioning member for positioning said photoconductive drum by holding said shaft support member;

a flange support member rotatably supporting the other flange; and a second positioning member for positioning said photoconductive drum by holding said flange support member;

wherein said shaft support member comprises, a tubular portion having a bore in which said conductive shaft is rotatably received, locking pawls for mating with an engaging portion included in said first positioning member, and knobs for mounting and dismounting said photoconductive drum from said first positioning member.

17. A device for supporting an image carrier included in an image forming apparatus, comprising:

a pair of flanges respectively mounted on opposite ends of the image carrier, and having respective through bores formed therein;

a shaft extending throughout said through bores of said pair of flanges;

a pair of locking members respectively formed in said shaft at opposite ends of said shaft, and each comprising flat portions facing each other and curved portions facing each other and formed by having a circumferential surface of the shaft cut away in parallel planes at opposite sides of in axis of said shaft, said pair of locking members each having an oval shape in a section perpendicular to the axis of said shaft; and a pair of shaft support members each including a circular hole having an inside diameter capable of receiving said curved portions of one of said pair of locking members, and an opening communicated to said circular hole and dimensioned to pass respective flat portions of the shaft when the shaft is oriented so that the parallel planes are perpendicular to the opening and to block the curved portions when the shaft is oriented with the parallel surfaces parallel to the opening;

said pair of locking members being respectively received in said circular holes of said pair of shaft support members upon passing of the flat portions through the opening to thereby lock said shaft in position.

18. A device as claimed in claim 17, wherein said pair of flanges are made of a conductive material.

19. A device as claimed in claim 17, further comprising a conductive member fitted on one of said pair of flanges and electrically connecting said shaft and an inner wall of the image carrier.

20. A device as claimed in claim 19, wherein said pair of shaft support members are made of metal.

21. A device as claimed in claim 19, wherein said pair of shaft support members are made of a conductive resin.

22. A device as claimed in claim 17, further comprising a pair of handles respectively positioned at the opposite ends of said shaft outside of said curved portions so as to be gripped by hand.

23. A device as claimed in claim 22, wherein at least one of said pair of handles includes a pawl, and wherein one of said shaft support members associated with said at least one handle includes a locking portion for stopping, when said at least one handle is rotated to a position where said curved portions of associated one of said pair of locking members contact a wall of said circular hole, a rotation of said at least one handle by mating with said pawl.

24. A device as claimed in claim 23, wherein at least one of said pair of handles is provided with a symbol for identifying an orientation in a right-and-left direction.

25. A device as claimed in claim 24, wherein said symbol is formed in relief.

26. A device as claimed in claim 25, wherein at least one of said pair of handles is formed with a first interference, and wherein one of said pair of shaft support members associated with said at least one handle is formed with a first projection which does not interfere with said first interference when the image carrier is mounted in a correct orientation in the right-and-left direction, but interferes with said first interference when the image carrier is mounted in an opposite orientation in the right-and-left direction.

27. A device as claimed in claim 26, wherein said shaft is formed with a pair of tank support portions respectively adjoining said pair of handles, wherein a waste toner tank including cleaning means for cleaning at least a surface of the image carrier is positioned above the image carrier, wherein said waste toner tank is selectively moved to a position where a pair of engaging portions formed at opposite ends thereof respectively mate with said pair of tank support portions of said shaft in the vicinity of the image carrier, or to a position above the image carrier and spaced from said preselected position, and wherein at least one of said pair of handles is formed with a second projection which does not interfere with the waste toner tank held in said predetermined position when said handle is rotated to a predetermined angular position, but interferes with said waste toner tank held in said predetermined position when said handle is not rotated to said predetermined angular position.

28. A device as claimed in claim 26, wherein said shaft is formed with a pair of tank support portions respectively adjoining said pair of handles, wherein a waste toner tank including cleaning means for cleaning at least a surface of the image carrier is positioned above the image carrier, wherein said waste toner tank is selectively moved to a position where a pair of engaging portions formed at opposite ends thereof respectively mate with said pair of tank support portions of said shaft in the vicinity of the image carrier, or to a position above the image carrier and spaced from said preselected position, wherein at least one of said pair of handles is formed with a second projection which does not interfere with the waste toner tank held in said predetermined position when said handle is rotated to a predetermined angular position, but interferes with said waste toner tank held in said predetermined position when said handle is not rotated to said predetermined angular position, and wherein said at least one handle is formed with a rounded edge which faces upward when said at least one handle is located at said preselected angular position.

29. A device for supporting an image carrier included in an image forming apparatus, comprising:

a pair of flanges respectively mounted on opposite ends of the image carrier, and having respective through bores formed therein;

a shaft extending throughout said through bore of said pair of flanges;

a pair of notched portions respectively formed at opposite ends of said shaft, and each comprising flat portions facing each other and curved portions facing each other and formed by having a circumferential surface thereof cut away in parallel planes at opposite sides of an axis of said shaft, said pair of locking members each having an oval shape in a section perpendicular to the axis of said shaft;

a pair of shaft support members each including a circular hole having an inside diameter capable of receiving said arcuate portions of one of said pair of notched portions, and an opening communicated to said circular hole and for passing said flat portions of said one of said pair of notched portions; and a pair of affixing members for respectively affixing said pair of shaft support members;

said pair of notched portions being respectively affixed to said pair of affixing members via said pair of shaft support members.

30. A device as claimed in claim 29, wherein said pair of flanges are made of a conductive material.

31. A device as claimed in claim 29, further comprising a conductive member fitted on one of said pair of flanges and electrically connecting said shaft and an inner wall of the image carrier.

32. A device as claimed in claim 31, wherein said pair of shaft support members are made of metal.

33. A device as claimed in claim 31, wherein said pair of shaft support members are made of a conductive resin.

34. A device as claimed in claim 29, further comprising a pair of handles respectively positioned at the opposite ends of said shaft outside of said curved portions so as to be gripped by hand.

35. A device as claimed in claim 34, wherein at least one of said pair of handles includes a pawl, and wherein one of said shaft support members associated with said at least one handle includes a locking portion for stopping, when said at least one handle is rotated to a position where said curved portions of associated one of said pair of locking members contact a wall of said circular hole, a rotation of said at least one handle by mating with said pawl.

36. A device as claimed in claim 35, wherein at least one of said pair of handles is provided with a symbol for identifying an orientation in a right-and-left direction.

37. A device as claimed in claim 36, wherein said symbol is formed in relief.

38. A device as claimed in claim 37, wherein at least one of said pair of handles is formed with a first interference, and wherein one of said pair of shaft support members associated with said at least one handle is formed with a first projection which does not interfere with said first interference when the image carrier is mounted in a correct orientation in the right-and-left direction, but interferes with said first interference when the image carrier is mounted in an opposite orientation in the right-and-left direction.

39. A device as claimed in claim 38, wherein said shaft is formed with a pair of tank support portions respectively adjoining said pair of handles, wherein a waste toner tank including cleaning means for cleaning at least a surface of the image carrier is positioned above the image carrier, wherein said waste toner tank is selectively moved to a position where a pair of engaging portions formed at opposite ends thereof respectively mate with said pair of tank support portions of said shaft in the vicinity of the image carrier, or to a position above the image carrier and spaced form said preselected position, and wherein at least one of said pair of handles is formed with a second projection which does not interfere with the waste toner tank held in said predetermined position when said handle is rotated to a predetermined angular position, but interferes with said waste toner tank held in said predetermined position when said handle is not rotated to said predetermined angular position.

40. A device as claimed in claim 38, wherein said shaft is formed with a pair of tank support portions respectively adjoining said pair of handles, wherein a waste toner tank including cleaning means for cleaning at least a surface of the image carrier is positioned above the image carrier, wherein said waste toner tank is selectively moved to a position where a pair of engaging portions formed at opposite ends thereof respectively mate with said pair of tank support portions of said shaft in the vicinity of the image carrier, or to a position above the image carrier and spaced from said preselected position, wherein at least one of said pair of handles is formed with a second projection which does not interfere with the waste toner tank held in said predetermined position when said handle is rotated to a predetermined angular position, but interferes with said waste toner tank held in said predetermined position when said handle is not rotated to said predetermined angular position, and wherein said at least one handle is formed with a rounded edge which faces upward when said at least one handle is located at said preselected angular position.

* * * * *